United States Patent [19]

Batch et al.

[11] Patent Number: 4,615,491

[45] Date of Patent: Oct. 7, 1986

[54] GYRATORY CRUSHER WITH AUTOMATIC TRAMP IRON RELEASE

[75] Inventors: Joseph Batch, Milwaukee; Robert G. Stafford, Mequon, both of Wis.

[73] Assignee: Telsmith Division Barber-Greene Company, Milwaukee, Wis.

[21] Appl. No.: 254,147

[22] Filed: Apr. 14, 1981

Related U.S. Application Data

[63] Continuation-in-part of Ser. No. 84,834, Oct. 15, 1979, abandoned.

[51] Int. Cl.[4] ..... B02C 2/04

[52] U.S. Cl. ..... 241/37; 241/207; 241/290

[58] Field of Search ..... 241/207, 216, 286, 290, 241/37

[56] References Cited

U.S. PATENT DOCUMENTS

| | | | |
|---|---|---|---|
| 2,288,069 | 6/1942 | Browning | 241/214 |
| 2,509,920 | 5/1950 | Gruender | 241/216 X |
| 3,328,888 | 7/1967 | Gieschen | 241/37 X |
| 3,533,568 | 10/1970 | Archer et al. | 241/215 X |
| 3,744,728 | 7/1973 | Treppish | 241/207 X |
| 3,750,965 | 8/1973 | Madden et al. | 241/37 X |
| 3,754,716 | 8/1973 | Webster | 241/37 X |
| 3,797,760 | 3/1974 | Davis et al. | 241/207 X |
| 4,233,600 | 11/1980 | Rogers et al. | 241/37 |

*Primary Examiner*—Mark Rosenbaum

*Attorney, Agent, or Firm*—James E. Nilles

[57] ABSTRACT

The crusher of this invention has a conical crushing head that gyrates in an annular lower frame member. An upper frame member that seats on the lower frame member in a normal operative position comprises a bowl that cooperates with the head to define a crushing gap. Upright, circumferentially spaced double-acting hydraulic jacks are connected between the lower frame member and a tie ring surrounding it; and upright, circumferentially spaced tie rods connect the tie ring with the upper frame member. Preferably the piston rods of the jacks project downward. The upper jack chambers are normally communicated with a fluid pressure system that maintains fluid in them at a predetermined pressure and comprises an accumulator charged by a hydraulic pump that is controlled by a pressure responsive switch. A relief valve near each jack vents fluid from its upper chamber to its lower one when pressure in said upper chamber exceeds said predetermined value by a predetermined amount, as when tramp iron lifts the bowl. The lower chambers are normally communicated with a source of unpressurized fluid. A selector valve reverses the connections to the jack chambers for bowl lifting.

9 Claims, 3 Drawing Figures

48
49
27
47
8
17
18
4
46
14
3
24
16
22
5
10
9
7
6
12
23
20
21
3
31
3
44
28
29
25
35
27
37
26
38
40
41
42

GYRATORY CRUSHER WITH AUTOMATIC TRAMP IRON RELEASE

RELATED APPLICATION

This application is a continuation in part of our copending application, Ser. No. 06/084,834, filed Oct. 15, 1979, now abandoned.

FIELD OF THE INVENTION

This invention relates to crushers of the type wherein a gyratory substantially conical crushing head and a relatively fixed bowl or concave cooperate to define a crushing gap; and the invention is more particularly concerned with automatic means in such a crusher whereby the bowl is biased down to a normal operative position relative to the head, from which position the bowl can rise as necessary to permit substantially uncrushable material to pass through the crushing gap without harm to the crushing surfaces, and whereby the bowl is immediately returned to its operative position after being so elevated.

BACKGROUND OF THE PRIOR ART

In a crusher of the type to which this invention relates, a generally conical crushing head is mounted on an upright eccentric shaft to be gyrated by rotation of the shaft. On the relatively stationary frame of the crusher there is an annular crushing bowl or concave which more or less overlies and surrounds the crushing head and cooperates with it to define a gap that comprises an annular crushing chamber. Material to be crushed is fed downward through the crushing chamber to be crushed between the bowl and the head as the head gyrates.

One of the problems that has received much attention in the gyratory crusher art is that which arises upon the entry of so-called tramp iron—substantially uncrushable material—into the annular crushing chamber. If the bowl is confined against rising in relation to the head when tramp iron is caught in the crushing gap, there is a high probability of damage to the crushing surface of the bowl or the head, or both, that will put the crusher out of service for a substantial time while the damaged surface is replaced. To prevent such damage, it has been usual to arrange the bowl of a gyratory crusher on an upper frame member that normally rests concentrically upon a fixed lower frame member but can be forced up off of the lower frame member by tramp iron in the crushing chamber. Since the weight of the upper frame member is not great enough to hold it down against the upward forces exerted upon the bowl during normal crushing, it has been more or less conventional to bias the upper frame member downwardly by means of heavy springs whereby the upper frame member was maintained firmly seated on the lower one during normal crushing but was permitted to rise under the greater force developed when tramp iron was present. The springs had to be under a substantial preload by which the bowl was held down, and when the bowl was lifted by tramp iron, this already-high force on the springs was further substantially increased. Usually such a spring arrangement prevented serious damage to the crushing surfaces, but it nevertheless required a fairly prolonged shut-down of the crusher for removal of tramp iron because the spring force had to be relieved and the upper frame member had to be lifted enough to permit the tramp iron to fall through the crushing gap.

Relief of spring tension usually entailed the removal of nuts on numerous tie rods that extended through the springs and transmitted spring forces to the upper frame member; and during such disassembly the high energy stored in the springs endangered those doing the work.

The serious and troublesome nature of the tramp iron problem is attested by the relatively large number of patents that have issued on expedients intended to solve it.

One of the earliest of these was U.S. Pat. No. 2,679,984 to Gruender, issued in 1954, wherein the generally conventional springs were replaced by pneumatic pressure cylinder jacks that normally maintained a yielding predetermined downward biasing force upon the upper frame member. The upper frame member could rise under the force exerted by tramp iron in the crushing chamber, increasing the pressure in the pneumatic system, which thus functioned analogously to springs except that pneumatic pressure was not allowed to exceed a predetermined maximum value that was established by a relief valve. For freeing the tramp iron, pressure in the cylinders could be relieved by opening a manually operable valve, and the upper frame member then had to be lifted. Although offering advantages over a spring biased upper frame member, the arrangement could not provide for powered lifting of the bowl when elevation of the bowl became necessary, and it had the further important disadvantage that it needed a large supply of air at high pressure and therefore was not energy efficient.

The employment of single-acting fluid pressure jacks to exert normal downward bias upon an upper frame member was also disclosed in two U.S. patents to Johnson, U.S. Pat. No. 3,118,623 (reissued as U.S. Pat. No. Re. 29,970) and U.S. Pat. No. 3,281,083, and in U.S. Pat. No. 3,038,670 to Becker. In the apparatus of these patents the cylinder jacks functioned in substantially the same manner as the springs that they replaced, except that there was provision for manual relief of the biasing force that the jacks exerted.

In another approach to the problem, disclosed in U.S. Pat. No. 3,140,635 to Balmer et al, springs were employed to bias the upper frame member downwardly in a more or less conventional manner, and manually controlled single-acting fluid pressure jacks were arranged to lift the upper frame member against the biasing force of the springs when tramp iron was caught in the crushing gap. U.S. Pat. Nos. 3,009,660 to Symons et al and 3,162,387 to Symons disclose other arrangements employing the same general principles.

U.S. Pat. No. 2,597,548 to Traylor, Jr., disclosed an arrangement wherein fluid piston devices equipped with one-way bleed valves permitted tramp iron in the crushing gap to lift the bowl against spring bias but whereby downward spring biased return motion of the bowl was retarded to allow time for the tramp iron to pass out of the crushing chamber. In practice this arrangement was not likely to be consistently operative, because the biasing force of the springs increased as the bowl rose, and the tramp iron could not lift the bowl above a level at which it was clear of the tramp iron; hence spring force on the bowl could continue to hold the tramp iron captive in the crushing chamber.

In the crusher of U.S. Pat. No. 3,396,916 to Kemnitz et al, the bowl or concave was surrounded by a cylindrical wall on the fixed lower frame member that cooperated with a cylindrical outer surface on the bowl to define an annular hydraulic cylinder, and the bowl had a circumferential flange which was received in that cylinder to serve as its piston. Pressure fluid in the annular cylinder, above and below the circumferential flange, controlled the heightwise position of the bowl and could be used to raise the bowl for release of tramp iron. The bowl was hydraulically locked at the selected height and therefore could not yield upwardly to any significant extent until a valve in the hydraulic system was manually shifted for raising it.

In the crusher of U.S. Pat. No. 2,791,383 to Kjelgaard, a number of double-acting hydraulic jacks were connected between the lower frame and an upper frame member that comprised the bowl. Fluid under a predetermined pressure was maintained in the lower chambers of the jacks, and fluid that was in effect trapped in their upper chambers held the bowl at a desired height. For adjusting the bowl downward there was a hand pump by which fluid could be forced into the upper chambers of the jacks, and for adjustingly raising the bowl there was a manually operable valve through which the upper chambers could be controlledly drained. Also connected with the upper jack chambers was a pressure relief valve which opened for quickly draining those chambers if pressure in them exceeded a predetermined value—as when tramp iron in the crushing gap exerted an upward force on the bowl—thus automatically raising the bowl for tramp iron release. After each such tramp iron release the bowl had to be brought back down to its operative position by operation of the hand pump. The apparatus had the further disadvantage that any leakage of fluid out of the upper jack chambers allowed the bowl to rise, increasing the width of the crushing gap; and the bowl then had to be readjusted back to a position that was indeterminate in the first place.

U.S. Pat. No. 3,754,716 to Webster disclosed a generally similar arrangement wherein the hand pump of Kjelgaard was replaced by an electrically driven pump and wherein the adjusted position of the bowl was sensed electrically. When the bowl was raised for release of tramp iron, it was maintained in its lifted position for a predetermined period of time and thereafter was brought back down automatically to the electrically sensed position that it had occupied just before being raised. The electrical and hydraulic control system had to be rather complicated because the bowl had no mechanically defined position, and every jack had to be individually controlled in order to prevent the bowl from being established in a tipped position.

U.S. Pat. No. 2,680,571 to Bjarme disclosed a structure wherein double-acting pneumatic jacks were arranged to maintain a normal downward biasing force upon an upper frame member that comprised a concave. There was no provision for automatic relief of the downward bias when tramp iron was present in the crushing gap, but a manually operable valve could be repositioned to so reconnect the jacks that they lifted the upper frame member for release of tramp iron. In common with the arrangements disclosed in certain of the other patents discussed above, the pneumatic jacks in the crusher of the Bjarme patent were located at the top of the crusher, and in fact they projected a substantial distance above the top of the upper frame member. Such an arrangement is undesirable because it adds to the height of the crusher so that the machine is not adaptable to all installations. Furthermore, material to be crushed is fed into a gyratory crusher from above and it must therefore be lifted to a level from which it can fall into the crusher; hence, energy required for feeding material into a crusher is directly related to the height of the crusher. Over the long life of a crusher, and considering that the feed material is usually heavy, every additional inch of crusher height can entail a very significant cumulative energy expenditure.

The above discussed prior patents, and others like them, disclose that there has been a long standing need and desire to provide gyratory crushers with effective means for sensing the presence of tramp iron or other uncrushable material in the crushing gap and for promptly and automatically relieving downward force on the bowl in response to sensing of such material. A basic problem with respect to the provision of such automatically responsive apparatus is that of detecting the presence of tramp iron in the first place. Heretofore, in non-automatic systems, deceleration or stalling of the crusher drive motor has often been relied upon to signal the presence of tramp iron; but by the time rotor deceleration becomes perceptible, a substantial amount of damage can already have occurred. When the upper frame member that carries the bowl is not hydraulically locked against rising, as it was in the above-discussed Kjelgaard patent, an early and significant manifestation of the presence of tramp iron is a tilting rise of the upper frame member. Since such lifting can occur anywhere around the periphery of the crusher, an operator at a fixed control station is not in a good position to observe it immediately and react promptly to it. Any automatic device that provides for a yielding downward force upon the bowl, so that it can be lifted in response to the presence of tramp iron, must likewise take account of the tilting that the bowl tends to undergo when tramp iron is caught in the crushing gap.

It is not imperative that the bowl be positively lifted upon the detection of tramp iron in the crushing gap, to be held high enough for the tramp iron to fall freely through the gap, but an automatic tramp iron release should at least be so arranged that there is no substantial increase in the downward force upon the bowl as it rises, so that the bowl can be lifted by the upward force that tramp iron exerts upon it. On the other hand, during normal operation the bowl should be confined in a defined operative position by a downward force upon it that yields to the lifting action of tramp iron. The normal position of the bowl should be defined in such a manner—preferably by solid abutment means—that the bowl can be brought directly back to it after being so lifted.

It will be apparent at this point that providing for the presence of tramp iron in a gyratory crusher is not a simple problem but instead presents numerous requirements, some of which are in apparent conflict with others. Heretofore no arrangement has been proposed that solves the basic problem and satisfies or resolves all of the requirements and desiderata.

SUMMARY OF THE INVENTION

The present invention is concerned with a crusher of the type comprising a cone or crushing head that gyrates in a stationary lower frame member and cooperates with a bowl or concave to define a crushing gap, and the general object of the invention is to provide energy-efficient apparatus whereby a predetermined downward force is normally imposed upon the bowl, to maintain it seated upon the lower frame member in an operative position, and whereby such downward force is prevented from increasing to any substantial extent when lifting of the bowl occurs, as from the presence of tramp iron in the crushing gap.

It is also a general object of the invention to provide, in a gyratory crusher, energy efficient automatic apparatus that responds to the presence of uncrushable material in the crushing gap by allowing the bowl to lift to an extent that allows such material to pass through the crushing gap, and to do so without substantial increase in the reaction forces imposed upon the opposing surfaces of the bowl and the crusher head by the material between them, so that those surfaces suffer no greater damage from tramp iron in the crushing gap than from the crushable material they are intended to act upon. Thus it is an ultimate objective of the invention to provide a very long useful life for the crushing surfaces of a gyratory crusher.

A more specific but very important object of this invention is to provide apparatus of the character described that permits tramp iron and the like to work through the crushing gap without stalling the crusher and without endangering the crushing gap surfaces, said apparatus being fully automatic in the sense that it requires no attention on the part of an operator, neither for effecting relief of downward force upon the bowl when tramp iron is present in the crushing gap nor for restoration of such downward force when the tramp iron has passed through the crushing gap.

Another and more specific object is to provide fully automatic apparatus which achieves the object last stated and which can be readily arranged to produce a signal for alerting an operator to the presence of tramp iron in the crushing gap and to the consequent need for removing the tramp iron from the output of the crusher.

Another specific object of the invention is to provide automatic apparatus of the character described that has no need for the powerful springs heretofore employed for biasing the bowl downward to its operative position, thus eliminating the dangers that such springs presented to personnel working around the crusher, especially at times when the bowl had to be raised for service or repair.

In this connection it is another specific object of the invention to provide automatic apparatus of the character described that can be installed on a crusher which is designed for the heretofore conventional bowl hold-down springs, without requiring extensive or costly modification of the crusher structure to adapt it to the apparatus of this invention.

A further specific object of the invention is to provide automatic bowl control apparatus of the character described that has a simple manually operable control valve that can be placed in one position for hydraulically lifting the bowl to a substantial elevation, for service or maintenance, and can be placed in another position for normal crushing operation with automatic tramp iron accommodation as above described.

In most gyratory crushers the bowl or concave has a threaded connection with the upper frame member proper, so that the crushing gap can be adjusted by rotation of the bowl in the upper frame member, to vary the heightwise position of the bowl relative to the cone; and normally a locking ring or similar expedient is provided for preventing undesired rotation of the bowl. A further specific object of this invention is to provide for the attainment of the previously described objectives with structure and apparatus which in no wise conflicts or interfers with conventional arrangements for adjusting the heightwise position of the bowl and for locking it in any selected position of heightwise adjustment.

These and other objects of the invention that will appear as the description proceeds are achieved in a crusher having a cone or crushing head that gyrates in an annular lower frame member and having an annular upper frame member which is normally supported in an operating position on said lower frame member and which comprises a bowl that cooperates with said cone to define a crushing gap. The apparatus of this invention normally imposes upon the upper frame member a predetermined downward force that yieldingly opposes its elevation out of said position, which force is maintained without substantial increase in its magnitude upon elevation of the upper frame member out of said position, as by the presence of substantially uncrushable material in the crushing gap.

The apparatus of this invention is characterized by a plurality of double-acting jacks disposed at circumferentially spaced intervals around said frame members, each comprising a piston slideable in a cylinder and having a pair of pressure chambers in its cylinder at opposite sides of its piston. The apparatus further comprises means so connecting each of said jacks between the upper and the lower frame members that the jack can translate pressure of fluid in one of its said chambers into a downward force upon the upper frame member. The apparatus has hydraulic pressure means normally communicated with said one chamber of each jack, said hydraulic pressure means providing a source of fluid at substantially a predetermined pressure and comprising an accumulator, a pump for charging the accumulator with fluid, and pressure responsive control means operatively associated with the pump and the accumulator for directing fluid from the pump to the accumulator when fluid at the accumulator has less than said predetermined pressure and for preventing charging of the accumulator when fluid thereat has substantially said predetermined pressure. The apparatus has normally closed relief valve means connected between said one chamber of every jack cylinder and the other chamber thereof, said relief valve means being arranged to open for transferring fluid from said one chamber to said other chamber when fluid in said one chamber has a pressure which exceeds said predetermined pressure by a predetermined amount.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF INVENTION

Figure 1:
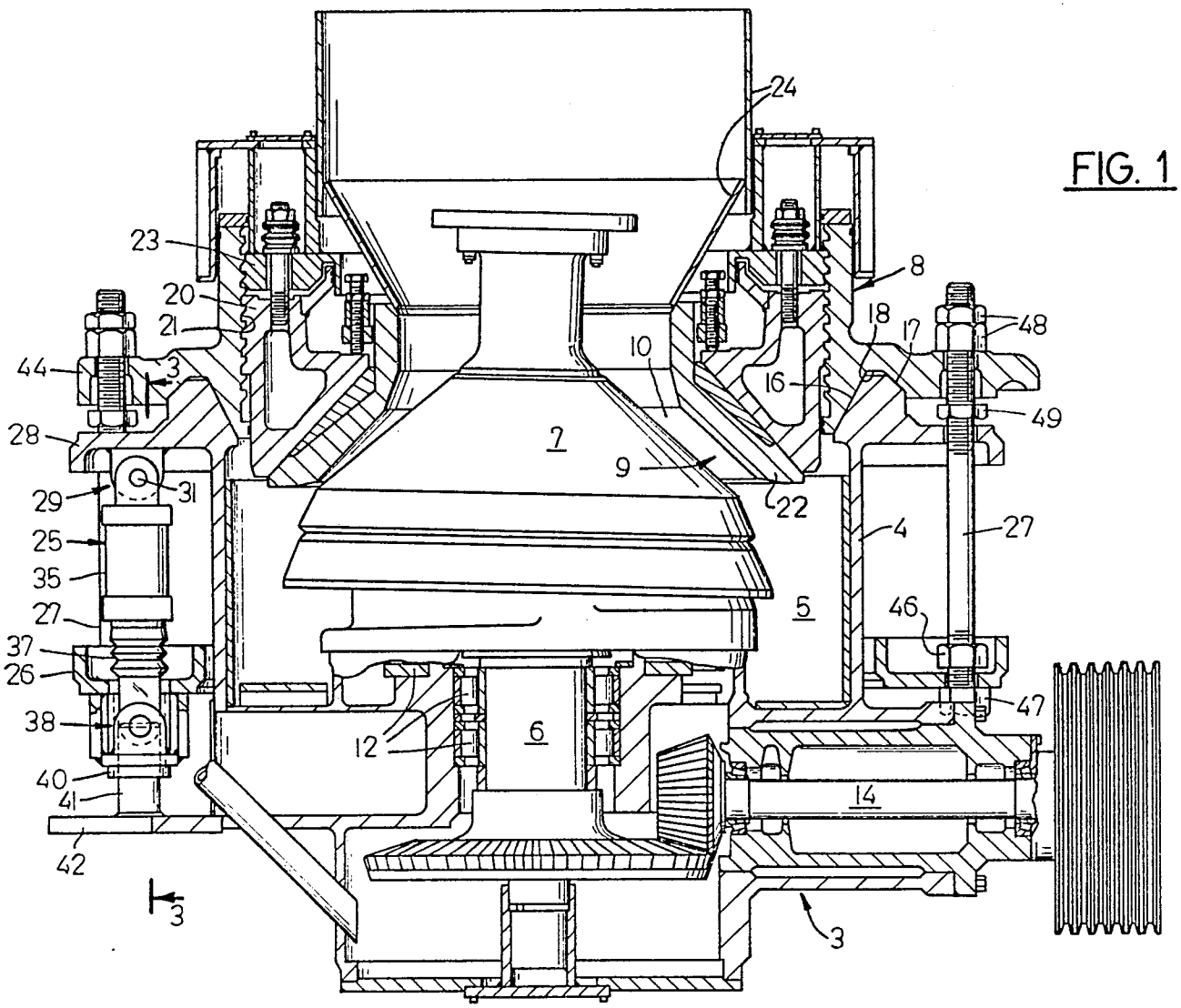
FIG. 1 is a view in vertical section through a gyratory crusher that embodies the principles of the invention.

Referring now to the accompanying drawings, the numeral 3 designates generally a relatively fixed lower frame member of a gyratory crusher which embodies the principles of this invention. The lower frame member 3 has an upright annular wall 4 that defines the lower or outlet portion 5 of a crushing chamber within the crusher. Mounted on an eccentric shaft 6 in the lower frame member 3 is a cone or crushing head 7 that is given a gyratory motion by rotation of the shaft 6. Concentrically seated on top of the annular wall 4 of the lower frame member is an upper frame member 8 that comprises an annular frusto-conical concave or bowl 9 which converges upwardly and thus faces downwardly and inwardly. The bowl or concave 9, which is in upwardly surrounding relation to the crushing head 7, cooperates with the crushing head to define a more or less annular crushing gap 10 that comprises the crushing chamber proper.

The eccentric shaft 6 and the crushing head 7 that it drives are mounted in sturdy bearings 12 in the lower frame member 3. Rotation is imparted to the eccentric shaft 6 by means of a horizontally extending drive shaft 14 that is also journaled in the lower frame member.

The rim portion of the annular wall 4 of the lower frame member tapers upwardly, being formed with one concentric conical surface 16 that faces obliquely upwardly and radially inwardly and another concentric conical surface 17 that faces obliquely upwardly and radially outwardly. Around the bottom of the annular upper frame member 8 there is a downwardly opening circumferential groove 18 that has downwardly divergent surfaces which mate with the conical surfaces 16 and 17 on the lower frame member, so that when the upper frame member is seated on the lower one it is maintained concentric to the lower one by the cooperation of those mating surfaces.

The bowl or concave 9 comprises an annular bowl support 20 which has a screw-threaded connection 21 with the upper frame member 8. A bowl liner 22 that serves as the stationary crushing surface of the machine is secured to the bowl support 20 in such a manner as to be readily detachable therefrom for replacement. The threaded connection 21 between the upper frame member 8 and the bowl support 20 enables the bowl support to be adjusted up and down in relation to the upper frame member, and hence in relation to the cone or crushing head 7, to provide for adjustment of the width of the crushing gap 10. Since crushing action imposes a tangential force upon the bowl, a locking ring 23 is threaded into the upper frame member 8 to releasably confine the bowl support 20 against rotation. The particular bowl and locking ring arrangement here illustrated is described and claimed in the copending Polzin et al application, Ser. No. 21,723, filed Mar. 19, 1979, now U.S. Pat. No. 4,198,003, which has a common assignee with this application. As the description of the present invention proceeds, it will become apparent that the particular form of connection between the upper frame member 8 and the bowl support 20 is in no wise material to the present invention because the invention is adaptable to crushers with practically all known arrangements for bowl support and bowl locking.

Material to be crushed is fed into the annular crushing gap 10 by way of a funnel-like hopper 24 on the bowl support, and such material passes through the downwardly tapering crushing gap 10 to be crushed between the bowl liner 22 and the crushing head 7 as the latter gyrates.

It will be apparent that crushing action imposes upon the bowl 9 a substantial upward force that tends to lift the upper frame member 8 out of its seated engagement upon the lower one. With the arrangement of the present invention, such upward forces are yieldingly resisted by hold-down means comprising a plurality of double-acting cylinder jacks 25, a tie ring 26 and a plurality of tie rods 27. The double-acting cylinder jacks 25 are connected between the fixed lower frame member 3 and the tie ring 26, while the tie rods 27 connect the tie ring 26 with the upper frame member 8.

Figure 3:
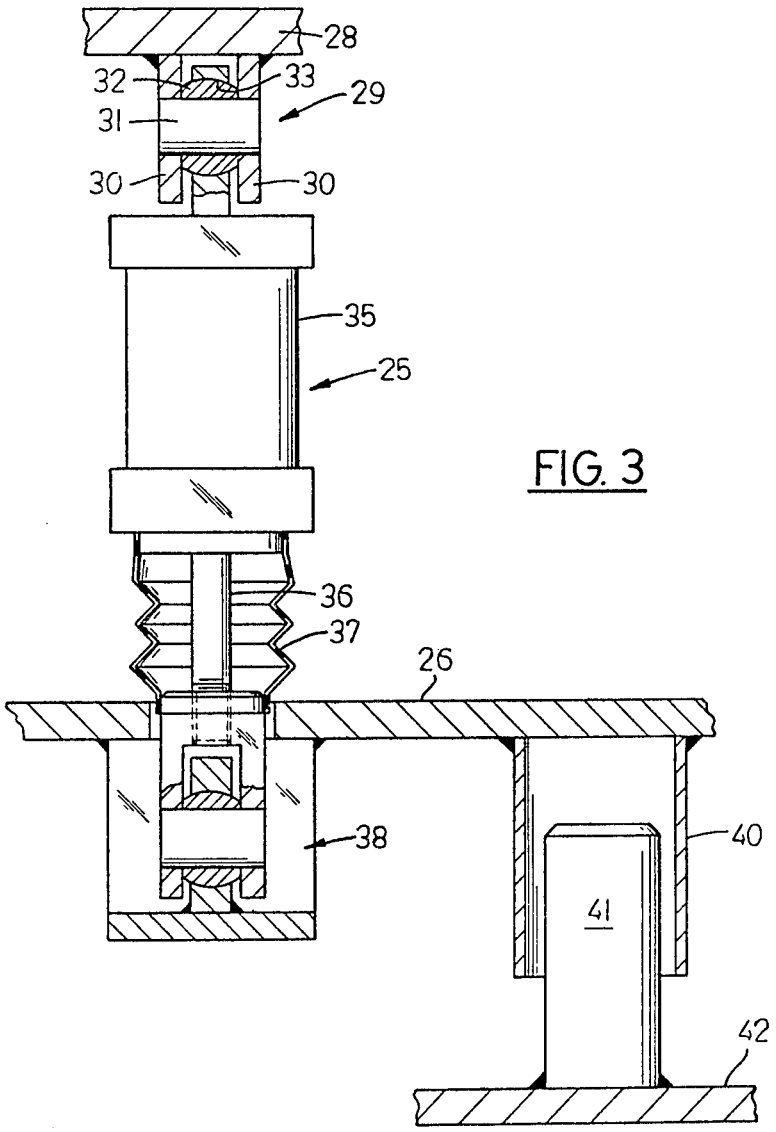
FIG. 3 is an enlarged fragmentary view in section, taken on the plane of the line 3—3 in FIG. 1.

The double-acting cylinder jacks 25 are arranged at regular circumferential intervals in a circle around the fixed frame member 3, with their axes parallel to the crusher axis and equidistant therefrom. The cylinder 35 of each jack 25 thus has an upper or blind end chamber 59 above its piston 36 and a lower or rod end chamber 60 below its piston. The connection of each jack 25 to the fixed lower frame member 3 comprises a sturdy radially outwardly projecting flange 28 on the lower frame member, near its top, to which the upper end of the jack cylinder 35 has a swiveling connection 29. As best seen in FIG. 3, the flange 28 has a pair of fixed downwardly projecting lugs 30 for each swiveling connection 29. A horizontal pin 31 that extends transversely to the lugs 30 and is fixed in them carries a coaxial spherical element 32, and the jack cylinder has a spherical socket 33 at its upper end in which the spherical element 32 is engaged. The jack is thus free for limited swinging in all directions about its connection with the flange 28.

The piston rod 36' of each jack has a swiveling connection 38 to the tie ring 26 that is generally like the upper swivel connection 29. Because each jack has its cylinder 35 uppermost and its piston rod 36' projecting downwardly, the piston rod is to some extent protected from dust and dirt by the cylinder above it. In addition, the piston rod 36' is surrounded by a protective axially expansible and contractable boot 37 of rubber or the like that extends between the cylinder 35 and the tie ring 26.

The tie ring 26, which surrounds the lower frame member 3 near the bottom thereof, is moved down by extension of the jacks 25 and moved up by their retraction. The tie ring 26 is substantially confined to such up and down motion, and is restrained against substantial rotational and radial motion, by cooperating guide means on it and on the lower frame member 3 comprising (as best seen in FIG. 3) a pair of tubular guide elements 40 that project down from the tie ring at diametrically opposite locations on it, and a pair of upright stud-like guide elements 41 that are fixed to flange-like supports 42 near the bottom of the lower frame member, at opposite sides thereof, and project up into the respective tubular guide elements 40 with a loose sliding fit.

The lifting and lowering forces that are imposed upon the tie ring 26 by the jacks 25 are in turn transferred to the upper frame member 8 by the upright tie rods 27, which are spaced at uniform circumferential distances from the jacks and alternate with the jacks around the lower frame member 3. Each tie rod 27 is connected at its lower end to the tie ring 26 and is connected at its upper end to a circumferential radially outwardly projecting force-receiving flange 44 on the upper frame member 8. The flange 44 is near the bottom of the upper frame member 8 but is spaced above the jack supporting flange 28 on the lower frame member. Each tie rod 27 passes through the jack supporting flange 28 on the lower frame member at a hole therein that affords substantial clearance for the tie rod.

Both end portions of each tie rod 27 are threaded to receive nuts 46–49 that provide abutments by which vertical forces are transferred to and from the tie rod. Thus the lower end portion of each tie rod 27 extends through a hole in the tie ring 26, and nuts 46 and 46 above and below the tie ring substantially constrain the tie ring and the tie rod to move up and down in unison, although preferably with a little lost motion between them; and nuts 48 and 49 at the top of the tie rod similarly connect it with the flange 44 on the upper frame member. The tie rod holes in the tie ring 26 and the upper flange 44 fit the tie rods 27 somewhat loosely, and together with the slightly loose connections provided by the nuts 46–49 they allow the tie rods to swing or swivel to some extent relative to the tie ring 26 and the flange 44, thus accommodating tilting of the upper frame member 8 and the tie ring 26 relative to the tie rods.

It will be evident that the adjustability of the nuts 47 and 48 allows downward biasing forces that originate from the jacks 25 to be imposed upon the upper frame member 8 uniformly all around it. It will also be noted that neither the jacks 25 nor the tie rods 27 increase the height of the crusher since they are located wholly below the level of the top of the upper frame member 8 and are, moreover, compactly arranged close to the side surfaces of the crusher body. Furthermore, since the upper frame member 8 is lifted out of engagement with the lower frame member 3 by retraction of the jacks 25, the inherently greater force exerted for extension of the jacks is employed to hold down the upper frame member against crushing forces which tend to lift it.

Figure 2:
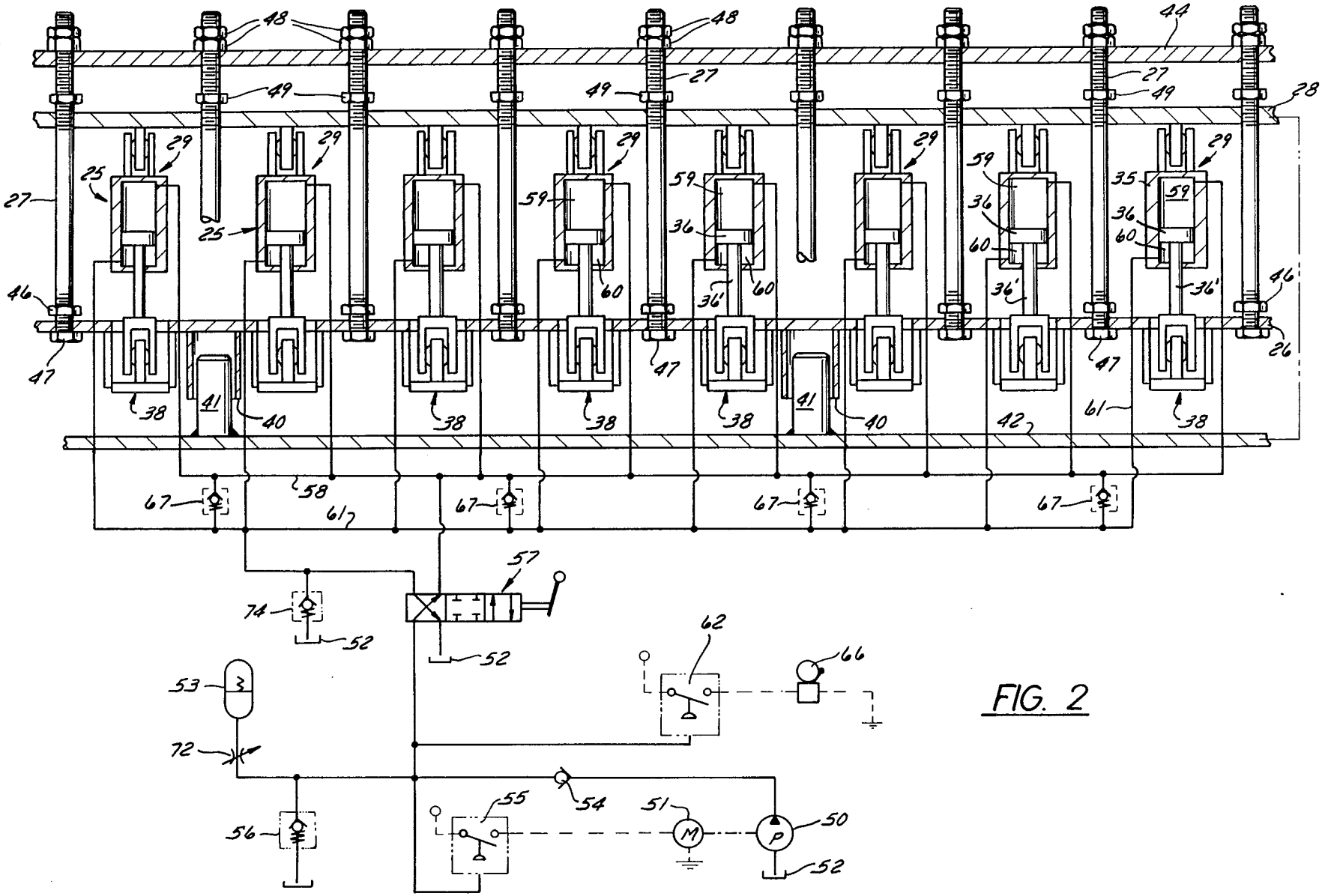
FIG. 2 is a circuit diagram of the means for controlling the upper frame member in a gyratory crusher embodying the principles of the invention.

However, by reason of the hydraulic circuit that is diagrammatically illustrated in FIG. 2, the downward force that the jacks 25 impose upon the upper frame member 8 is maintained at a predetermined value and is a yielding one that permits the upper frame member to be lifted by tramp iron or the like in the crushing gap 10. The hydraulic circuit also ensures that there will be no substantial increase in that downward force when any lifting of the upper frame member occurs.

In general the hydraulic circuit apparatus comprises an accumulator 53 for maintaining fluid in the system under pressure, a pump 50 for charging the accumulator with fluid drawn from a reservoir 52, and pressure control means (described hereinafter) cooperating with the pump and the accumulator to maintain fluid pressure at the accumulator at substantially a predetermined value. The pump 50 is preferably driven by an electric motor 51, and the pressure control means can therefore comprise a pressure responsive switch 55 by which the motor 51 is turned on and off as necessary to maintain pressure at the accumulator at said predetermined value. The pressure control means can also comprise a relief valve 56 that opens in the event fluid pressure at the accumulator substantially exceeds said predetermined value, discharging the excess fluid to the reservoir 52. A check valve 54, connected downstream from the pump 50 but upstream from the accumulator 53 and the relief valve 56, prevents the accumulator from discharging through the pump when the pump is not operating.

At the pressure fluid port of the accumulator 53 there is a needle valve 72 that can be manually closed to cut off the accumulator from the rest of the hydraulic system for service and maintenance. Normally, the needle valve 72 is open, and it has some throttling effect upon flow of fluids into and out of the accumulator, although it does not present enough restriction to fluid flow to have any material effect upon charging of the accumulator by the pump 50.

The hydraulic pressure system just described is connectable with the several hydraulic jacks 25 through a manually operated selector valve 57. In a normal position of the selector valve 57, in which it is shown in FIG. 2, it communicates the fluid port of the accumulator 53 with a header or manifold 58 that is in turn communicated with the upper (blind end) fluid chamber 59 of every jack cylinder 35. The lower (rod end) chamber 60 of each cylinder 35 is communicated with another manifold 61. When the selector valve 57 is in its normal position, it communicates the manifold 61 with the reservoir 52. The reservoir 52 is so located that fluid in it has a normal level somewhat above that of the manifold 61, so that fluid at substantially zero pressure normally fills the manifold 61 and the lower chambers 60 of the jacks. The two manifolds 58 and 61 are preferably circular, in surrounding relation to the crusher, for convenient connection to the respective cylinder chambers 59 and 60 of all of the jacks 25.

It will now be apparent that when the selector valve 57 is in its normal position, which it always occupies when the crusher is operating, there is fluid in the upper (blind end) chambers 59 of the jack cylinders at the predetermined pressure maintained by the accumulator 53, and such pressure fluid imposes upon the upper frame member 8 a strong but yielding downward bias that tends to maintain the upper frame member in its operative position, seated upon the lower frame member 3. Since there is zero pressure in the lower cylinder chambers 60, the magnitude of the downward biasing force exerted by the jacks 25 is determined by the pressure maintained at the accumulator 53.

If there is any leakage in the hydraulic system (e.g., across pistons 36), the pump 50 operates automatically, under control of the pressure switch 55, as and when the accumulator needs recharging, for maintenance of the predetermined fluid pressure. Thus the motor 51—which is the only energy-consuming device in the bowl control apparatus—operates only infrequently and then only for short periods.

Connected between the upper chamber header 58 and the lower chamber manifold 61 are a plurality of relief valves 67, each of which is adjusted to open and pass fluid from the header 58 into the manifold 61 when pressure in the header 58 exceeds the above-mentioned fluid pressure value by a predetermined amount. Preferably there are enough of the relief valves 67 so that there is one for each pair of jacks 25, and each relief valve 67 is so located as to be near the connections of its pair of jack cylinders with the header 58 and the manifold 61.

When tramp iron or other uncrushable material enters the crushing gap 10 and exerts upon the upper frame member 8 a high enough upward force to raise it from its operative position, such lifting will usually occur at only one side of the crusher, and consequently only one or a few jacks 25 at that side of the crusher will have their pistons 36 raised by the lifting of the bowl. When the piston rises in an affected jack, there is of course a more or less abrupt increase in the pressure of fluid in its upper chamber 59. Owing to the throttling effect of the needle valve 72 and the greater distance of the accumulator 53 from the affected jack, the increased pressure is imposed upon the adjacent relief valve 67, rather than being applied to substantial charging of the accumulator, and that relief valve 67 opens promptly, thus relieving pressure in the upper chamber 59 and transferring fluid into the lower chamber 60 of the same cylinder to prevent cavitation in it. The amount of fluid discharged from an upper blind end chamber 59 is somewhat greater than is needed to fill the void in the lower rod end chamber 60, and the excess fluid drains to the reservoir 52 through the manifold 61 and the selector valve 57. To ensure prompt opening of the relief valves 67 and fast transfer of fluid from an upper chamber 59 to a lower chamber 60, it is considered desirable to enlarge the ports of commercially available double acting cylinders employed as the jacks 25.

A relief valve 67 will of course reclose before pressure in the adjacent chamber 59 is fully relieved; but it will be apparent that the apparatus functions in such a manner that even when the upper frame member rises to accommodate tramp iron in the crushing gap 10, the downward bias exerted upon the bowl (and imposed by it upon material in the crushing chamber) will not substantially exceed the normal downward bias maintained upon the bowl during crushing. This means that tramp iron in the crushing gap 10 will not exert upon the opposing surfaces of the bowl 9 and cone 7 any substantially greater force than those surfaces are required to sustain during normal crushing, and consequently those surfaces are unlikely to be damaged by the tramp iron. Furthermore, because of the continuance of near normal forces on the crushing surfaces, the cone 7 will continue to gyrate in the normal manner instead of being stalled, and the tramp iron will be worked through the crushing gap 10 while the bowl rises as necessary to accommodate it. Once the tramp iron has passed through the crushing gap, the upper frame member 8 will promptly reseat itself under the continuing downward bias upon it. The pump 50 may operate briefly for recharging the accumulator, to make up for the samll loss of fluid from the pressure system that occurs during passage of tramp iron.

Because of the uneventful manner in which tramp iron is dealt with by the crusher, it is desirable to alert an operator to the passage of tramp iron through it, for removal of such material from the crusher output. To that end a pressure responsive switch 62 is so connected in the hydraulic system as to be closed by pressure high enough to open one of the relief valves 67, and a signalling device 66 is electrically connected with that switch to be energized by its closure.

The apparatus of this invention provides in a very simple and efficient manner for full elevation of the upper frame member 8 and the bowl 9 to a raised position in which the bowl structure is accessible for repair and maintenance. For such powered bowl lifting the selector valve 57 is manually actuated to a position in which it communicates the accumulator 53 with the lower chamber manifold 61 and communicates the upper chamber manifold 58 with the reservoir 52. The lower chambers 60 of the jack cylinders are then supplied with fluid at the pressure maintained at the accumulator while the upper chambers 59 are vented to the reservoir 52. For safety, a pressure relief valve 74 is preferably connected to the manifold 61 with a vent outlet to the reservoir 52, for preventing pressure in the manifold 61 from exceeding the above-mentioned predetermined value by more than a predetermined amount.

Preferably the selector valve 57 is a three-position valve which can also be placed in a cut-off position at which the jack cylinders 35 and their manifolds 58, 61 are disconnected from the pressure system that comprises the accumulator 53, to facilitate repair and maintenance work on the apparatus.

By way of example, in a typical apparatus embodying this invention, the predetermined fluid pressure at the accumulator 53 was a nominal 1540 psi, that is, the pump 50 started whenever pressure dropped to 1400 psi and stopped when it reached 1540 psi; and each of the several relief valves 56, 67 and 74 was adjusted to open at 1600 psi. The difference between the 1540 psi predetermined pressure and the 1600 psi relief valve pressure was great enough to prevent undesired opening of the relief valves but small enough so that forces upon the crushing surfaces never materially exceeded those imposed upon them during normal crushing operation.

From the foregoing description taken with the accompanying drawings it will be apparent that this invention provides simple and effective means for preventing tramp iron damage to a gyrator crusher and for enabling tramp iron to pass through the crusher without interruption of normal crushing operation.

What we claim is:

1. In a crusher having a cone that gyrates in an annular relatively stationary lower frame member and having an annular upper frame member which is normally supportingly engaged against said lower frame member to occupy a defined operating position and which comprises a bowl that cooperates with said cone to define a crushing gap, bowl control means for normally imposing upon said upper frame member a predetermined downward force that tends to maintain said upper frame member in its operating position, said bowl control means being characterized by:

A. a plurality of double-acting hydraulic jacks disposed at circumferentially spaced intervals around said frame members, each comprising a piston slideable in a cylinder and having a pair of pressure chambers in its cylinder at opposite sides of its piston;

B. means so connecting each of said jacks between the upper and the lower frame members that pressure of fluid in one of said chambers of the jack cylinder is translated into a downward force upon the upper frame member;

C. hydraulic pressure means normally communicated with said one chamber of every jack, said hydraulic pressure means providing a source of fluid at substantially a predetermined pressure, comprising:

(1) an accumulator, (2) a pump for charging said accumulator with fluid, and (3) pressure responsive control means operatively associated with said pump and said accumulator for directing fluid from said pump to said accumulator when fluid at the accumulator has less than said predetermined pressure and for preventing charging of the accumulator when fluid thereat has substantially said predetermined pressure;

D. normally closed relief valve means connected between said one chamber of every jack cylinder and the other chamber thereof, said relief valve means being arranged to open for transferring fluid from said one chamber to said other chamber when fluid in said one chamber has a pressure which exceeds said predetermined pressure by a predetermined amount; and E. means venting the other chamber of every jack cylinder to a source of unpressurized fluid at all times that the crusher is in crushing operation.

2. The crusher of claim 1, further characterized by:

F. selector valve means connected with said jack cylinder chambers and with said hydraulic pressure means and said source of unpressurized fluid, said selector valve means (1) having a normal position in which it communicates (a) said one chamber of every cylinder with said hydraulic pressure means and (b) said other chamber of every cylinder with said source of unpressurized fluid, and (2) having an alternatively selectable bowl raising position in which it communicates (a) said other chamber of every cylinder with said hydraulic pressure means and (b) said one chamber of every cylinder with said source of unpressurized fluid.

3. The crusher of claim 1 wherein said means connecting each of said jacks between the upper and the lower frame members comprises:

(1) a first radially outwardly projecting circumferential flange on the lower frame member, near the top thereof, to which the cylinder of every jack is connected;

(2) a tie ring movably surrounding the lower frame member in downwardly spaced relation to said first flange, to which the piston of every jack is connected;

(3) a second radially outwardly projecting circumferential flange on the upper frame member, spaced above said first flange; and (4) a plurality of elongated tie rods arranged at circumferentially spaced intervals around the frame members, each having at a lower end thereof a connection with said tie ring and at an upper end thereof a connection with said second flange.

4. A crusher having a cone that gyrates in an annular relatively stationary lower frame member and having an annular upper frame member comprising a bowl that cooperates with said cone to define a crushing gap, said crusher being characterized by:

A. cooperating abutment means on said upper and lower frame members, engageable for support of the upper frame member upon the lower frame member in a predetermined operative position from which the upper frame member can be raised;

B. a plurality of double-acting hydraulic jacks arranged at circumferentially spaced intervals around the lower frame member, each having (1) a cylinder with a substantially upright axis, (2) a piston slidable in said cylinder and having a downwardly projecting rod, (3) upper and lower pressure chambers in said cylinder, at opposite sides of the piston, and (4) the lower chamber of every said cylinder being vented to a zone of unpressurized fluid at all times that the crusher is in crushing operation;

C. means providing a swivel connection between the upper end of each jack cylinder and the lower frame member, near the top of the latter;

D. a tie ring surrounding the lower frame member and to which the piston rod of each jack has a swivel connection;

E. a plurality of elongated upright tie rods at circumferentially spaced intervals around the frame members, through which upward and downward forces that the jacks impose upon the tie ring are transferred to the upper frame member, each of said tie rods (1) having at its lower end a connection with the tie ring and (2) having at its upper end a connection with the upper frame member;

F. hydraulic pressure means normally communicated with the upper chamber of every jack cylinder and providing a source of fluid at substantially a predetermined pressure, said hydraulic pressure means comprising (1) an accumulator, (2) a pump for charging said accumulator with fluid, and (3) pressure responsive control means operatively associated with said pump and said accumulator for directing fluid from said pump to said accumulator when fluid at the accumulator has less than said predetermined pressure and for preventing charging of the accumulator when fluid thereat has said predetermined pressure; and G. relief valve means adjacent to said cylinders of each jack, arranged to open when fluid in the upper chamber of the jack has a pressure which exceeds said predetermined pressure by a predetermined amount, for flow of fluid from said upper chamber to the lower chamber of the jack.

5. The crusher of claim 4, further characterized by:

H. a selector valve through which said upper chamber of each jack is normally communicated with said hydraulic pressure means and said lower chamber of each jack is normally communicated with a source of substantially unpressurized fluid, said selector valve having an alternatively selectable bowl lifting condition in which it communicates the lower chamber of each jack with said hydraulic pressure means and the upper chamber of each jack with said source of substantially unpressurized fluid.

6. A crusher having a cone that gyrates in an annular relatively stationary lower frame member and having an annular upper frame member comprising a bowl that cooperates with said cone to define a crushing gap, said crusher being characterized by:

A. cooperating abutment means on said upper and lower frame members, engageable for support of the upper frame member upon the lower frame member in a predetermined operative position from which the upper frame member can be raised;

B. a plurality of double-acting hydraulic jacks at circumferentially spaced intervals around the lower frame member, each having (1) a cylinder with a substantially upright axis, (2) a piston slideable in said cylinder, and (3) a pair of pressure chambers in said cylinder, at opposite sides of the piston;

C. means connecting each of said jacks for reaction between the upper and lower frame members whereby pressure fluid in one of said chambers of the jack imposes a downward force upon said upper frame member that tends to maintain it in its operative position;

D. a selector valve having connections with both of said chambers of every jack and having alternatively selectable normal and bowl-raising conditions;

E. a source of substantially unpressurized fluid that is connected with said selector valve to be communicated therethrough with the other chamber of every jack when the selector valve is in its normal position and to be communicated with said one chamber of every jack when the selector valve is in its bowl-raising position;

F. hydraulic pressure means connected with said selector valve to be communicated therethrough with said one chamber of every jack when the selector valve is in its normal position and to be communicated with said other chamber of every jack when the selector valve is in its bowl-raising position, said hydraulic pressure means comprising (1) an accumulator, (2) a pump for drawing fluid from said source and charging said accumulator, and (3) pressure responsive control means operatively associated with said pump and said accumulator for directing fluid from said pump to said accumulator when fluid at the accumulator has less than said predetermined pressure and for preventing charging of the accumulator when fluid thereat has substantially said predetermined pressure; and G. pressure relief valve means adjacent to each of said hydraulic jacks, arranged to open when pressure of fluid in said one chamber of an adjacent jack exceeds said predetermined pressure by a predetermined amount and which, when open, communicates said one chamber of the jack with its other chamber.

7. The crusher of claim 6 wherein the piston of each jack has a downwardly projecting rod and wherein said one chamber of each jack cylinder is the upper chamber thereof, further characterized by:

(1) a first substantially circular manifold surrounding said lower frame member, to which the upper chambers of the jacks have respective circumferentially spaced connections, said first manifold being connected with said selector valve for normal communication therethrough with said hydraulic pressure means;

(2) a second substantially circular manifold surrounding said lower frame member, to which the lower chambers of the jacks have respective circumferentially spaced connections, said second manifold being connected with said selector valve for normal communication therethrough with said source of substantially unpressurized fluid; and (3) said pressure relief valve means comprising a plurality of relief valves, one for each two hydraulic jacks, each said relief valve being connected with both of said manifolds near the connections thereto of the chambers of its two hydraulic jacks.

8. The crusher of claim 6 wherein the piston of each jack has a downwardly projecting rod and wherein said other chamber of each jack cylinder is the lower chamber thereof, further characterized by:

said source of substantially unpressurized fluid being substantially at the level of the lower chambers of the jack cylinders to provide for normal maintenance of substantially unpressurized fluid in those chambers.

9. The crusher of claim 6, further characterized by:

throttling means between said accumulator and said selector valve.

* * * * *